United States Patent [19]

Kompe et al.

[11] 3,989,007

[45] Nov. 2, 1976

[54] DEVELOPING CHAMBER FOR ELECTROSTATIC LATENT IMAGES

[75] Inventors: Dieter Kompe, Netphen-Deuz; Hermann-Josef Delvos, Sassenroth, both of Germany

[73] Assignee: U.S. Philips Corporation, New York, N.Y.

[22] Filed: Nov. 21, 1974

[21] Appl. No.: 525,827

[30] Foreign Application Priority Data

Dec. 7, 1973 Germany ..... 2361062

[52] U.S. Cl. ..... 118/637

[51] Int. Cl.[2] ..... G03G 15/09

[58] Field of Search ..... 118/637; 355/3 DD; 427/18

[56] References Cited

UNITED STATES PATENTS

| | | | |
|---|---|---|---|
| 2,890,968 | 6/1959 | Giaimo, Jr. | 118/637 |
| 2,956,487 | 10/1960 | Giaimo, Jr. | 118/637 |
| 3,117,884 | 1/1964 | Greig | 118/637 |
| 3,547,077 | 12/1970 | Sage | 118/637 |
| 3,620,617 | 11/1971 | Kelly et al. | 118/637 |
| 3,666,518 | 5/1972 | Luttman et al. | 118/637 |
| 3,754,526 | 8/1973 | Caudill | 118/637 |
| 3,863,602 | 2/1975 | Mueller et al. | 118/637 |

*Primary Examiner*—Louis K. Rimrodt
*Assistant Examiner*—Douglas Salser
*Attorney, Agent, or Firm*—Frank R. Trifari; David R. Treacy

[57] ABSTRACT

In a developing chamber for electrostatic latent images, to avoid potential fluctuations within the developer, in particular in the field of the magnet, and to increase the frictional forces between the toner and the paper, an auxiliary electrode which is at the same electric potential as the chamber is disposed in the chamber at a slight distance from the record carrier, in the field of the magnet.

3 Claims, 1 Drawing Figure

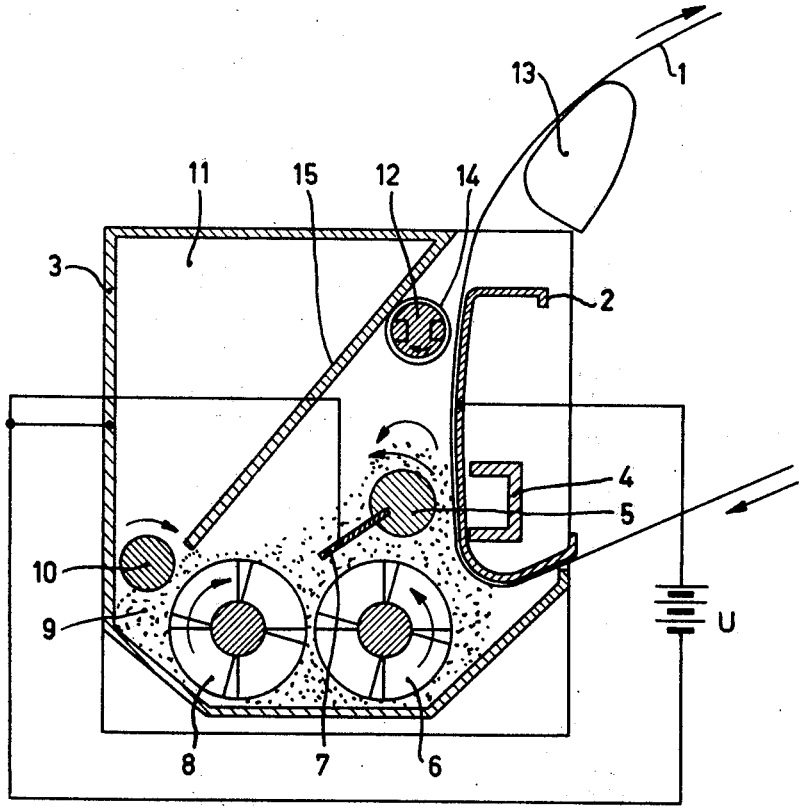
13
1
11
15
12
14
3
2
4
5
10
9
U
8
7
6

DEVELOPING CHAMBER FOR ELECTROSTATIC LATENT IMAGES

BACKGROUND OF THE INVENTION

1. Field of the Invention

The invention relates to a developing chamber for electrostatic latent images which is provided with a device by which a developer consisting of electroscopic particles and a carrier material can be applied in the field of a magnet to a record carrier passed through the chamber, and can be carried along by the record carrier owing to frictional forces. The developer required is a mixture of fine electroscopic particles, frequently referred to as toner, and a granular carrier material. The two materials are charged triboelectrically and hence adhere to one another. When this developer comes into contact with the record carrier provided with the latent image, the carrier grains give up the toner to the record carrier owing to the electrostatic force of attraction. The carrier grains themselves return to the developing chamber, where they are recharged with toner. The developer may be supplied to the record carrier, for example, by the cascade method or, in the case of ferromagnetic carrier materials, by the turbulence chamber method.

2. Description of the Prior Art

In the cascade method, the developer is conveyed to an elevated part of the record carrier and then flows down over the surface of the record carrier after the fashion of a waterfall to the bottom of the chamber and subsequently is conveyed upward again. In order to intensify development of the latent image, particularly if large areas are to be developed, additional baffle plates may be inserted into the cascade flow by which the developer is pressed against the record carrier. The record carrier travels in the direction in which the developer is conveyed. If in addition the baffle plate is connected to a voltage source, the pressure on the record carrier and hence the intensity of image development can be increased by the ensuing potential drop. An arrangement of this type is described, for example, in German Offenlegungsschrift No. 2,118,629.

In the turbulence chamber method the developer, which in this case consists of a toner and powdered iron, is attracted in the field of a magnet disposed behind the record carrier which travels in a substantially vertical direction and is carried along by the record carrier owing to frictional forces until it drops down again at the upper edge of the magnetic field (German Offenlegungsschrift No. 1,522,620). Circulation of the developer in such a "turbulence eddy" requires no external driving elements except those for paper transport. Because the developer owing to its content of metal carrier material is electrically conductive, it can simultaneously perform the function of the auxiliary electrode referred to in the above-described cascade method. This method has the advantage that the developer is in contact with the record carrier, while in the cascade method the effect of the auxiliary electrodes is adversely affected by the larger distance.

With these known apparatus the conductivity of the loosely cohering developer mixture in the turbulence chamber, particularly in the case of comparatively high concentrations of toner, is comparatively low so that the uneven transport of charged toner particles by the record carrier may give rise to undefined potential conditions in the layer of developer in contact with the record carrier.

In the chambers described above the developer is carried along by the paper (the record carrier) without any slip, in contrast with, for example, what is generally referred to as the magnetic brush method in which the developer rubs on the paper. However, a certain degree of friction promotes intimate contact between the developer and the record carrier and improves development of the charge image.

SUMMARY OF THE INVENTION

An object of the present invention is to avoid potential fluctuations in the developer mixture of the turbulence chamber and at the same time to improve development of the charge image by friction between the developer and the record carrier.

For this purpose according to the invention the record carrier passes along a rear wall portion of the chamber through the field of the magnet disposed externally of the chamber, an auxiliary electrode which extends across the entire width of the record carrier being disposed in the chamber in the field of the magnet at a slight distance from the record carrier, and a bias voltage (U) being set up between the rear wall portion of the chamber on the one hand and the remainder of the chamber and the auxiliary electrode on the other hand. The auxiliary electrode, which is at the same electric potential as the chamber, imparts an accurately defined adjustable potential to the developer throughout the entire developing area whilst the rear wall of the chamber, which guides the record carrier, can be given a different potential. The potential difference between the developer and the rear wall of the chamber enables the developing intensity and the background density to be adjusted in known manner.

The auxiliary electrode further ensures that the developer rubs over the record carrier. The resulting intimate contact with the record carrier improves development of the charge image.

BRIEF DESCRIPTION OF THE DRAWING

An embodiment of the invention will now be described, by way of example, with reference to the accompanying diagrammatic drawing which is a sectional view of the developing chamber and from which all the components of an electrostatic printer which are not absolutely necessary for a good understanding of the invention have been omitted, in particular the printing station itself and the paper transport drive.

DESCRIPTION OF THE PREFERRED EMBODIMENTS

Referring now to the FIGURE, a record carrier 1 which is provided with a latent image is moved in the direction indicated by the arrows and conveyed vertically upwards along a rear wall portion 2 of the chamber. In the field of a permanent magnet 4 which attracts the developer onto the record carrier 1, toner is applied from the developer mixture to the charged areas of the latent images on the record carrier 1. At the exit port of the developing chamber, a cleaning magnet 12 provided with at least two poles around its circumference revolves in a stationary tube 14 and removes any residual iron grains which may still adhere to the record carrier 1, entraining them over the outer wall of the tube 14 to a wall 15 of the chamber where it drops them into the chamber. After leaving the chamber the record carrier 1 slides over a fixing station 13, which bonds the developed image to the paper to give a non-erasable durable image.

Mixing rollers 6 and 8 which revolve in the directions indicated by the arrows are disposed close to the bottom of the chamber and continuously provide thorough mixing of the developer 9. New toner is supplied, in amounts determined by consumption, by a toner supply roller 10 to the developer 9 from a toner container 11.

An auxiliary electrode 5 is disposed near the magnet 4 above the mixing roller 6. In the embodiment shown the auxiliary electrode takes the form of a round bar. However, it may have any suitable shape. The auxiliary electrode is rigidly secured to the side walls of the chamber in a manner not shown. It is provided with a baffle plate 7 by which the part of the developer mixture that slides over the auxiliary electrode 5 and then drops down is returned to a location in the developing chamber such that it is thoroughly mixed with the remainder of the developer.

Thus in the vicinity of the magnet 4 the developer has a highly conductive connection to the other parts of the chamber via the auxiliary electrode 5 so that it is at the same potential. By applying a bias voltage U between the front wall 3 of the chamber and the rear wall 2 insulated therefrom, these walls being made of electrically conductive material, the intensity of charge image development and the background density can be accurately adjusted.

The auxiliary electrode 5 further ensures, that the flow of the developer mixture is slowed down before it reaches the magnet 4 so that development of the charge image is improved by friction and the associated intimate contact between the developer and the paper.

More intense contact may also be achieved by increasing the strength of the magnet 4. However, this has the disadvantage that owing to increased normal forces exerted on the paper 1 the frictional forces between the paper and the rear wall of the chamber also may undesirably be increased. In addition, the increased normal forces by which the developer is pressed against the paper may involve increased undesirable background density. Slight friction between the developer and the paper at the lowest possible pressure yields satisfactorily developed images having a low background density, for if the toner particles which provide background density are not firmly pressed to the record carrier and hence loosely adhere to its uncharged areas, they may readily be removed by rubbing.

What is claimed is:

1. A developing chamber for electrostatic latent images provided with a device by which a developer consisting of electroscopic particles and a carrier material can be applied in the field of a magnet to a record carrier passed through the chamber, and can be carried along by the record carrier because of frictional forces, comprising:

a magnet which produces a field;

a chamber having walls comprising an electrically conductive material, and a rear wall portion comprising an electrically conductive material and having an inner surface, said rear wall portion being arranged such that a record carrier can be passed through said chamber along said surface through said magnet field, said magnet being external to the chamber;

an auxiliary non-rotating electrode disposed in said chamber so as to extend across the entire width of a record carrier passing therethrough, said electrode being a slight distance from said record carrier such that developer between the electrode and the carrier is maintained at a same potential as developer in other parts of the chamber, and means for applying a bias voltage between said rear wall and said electrode, and for maintaining said chamber walls and said electrode at a same electric potential.

2. A chamber as claimed in claim 1, wherein said auxiliary electrode is rigidly secured to said chamber walls.

3. A chamber as claimed in claim 2, wherein said chamber also comprises a baffle plate rigidly connected to the auxiliary electrode for guiding returning developer.

* * * * *